US008644540B2

(12) United States Patent
Rasmussen et al.

(10) Patent No.: US 8,644,540 B2
(45) Date of Patent: Feb. 4, 2014

(54) HEARING DEVICE

(75) Inventors: Karsten Bo Rasmussen, Smorum (DK); Svend Oscar Petersen, Smorum (DK)

(73) Assignee: Oticon A/S, Smorum (DK)

( * ) Notice: Subject to any disclaimer, the term of this patent is extended or adjusted under 35 U.S.C. 154(b) by 618 days.

(21) Appl. No.: 12/699,543

(22) Filed: Feb. 3, 2010

(65) Prior Publication Data

US 2010/0195858 A1 Aug. 5, 2010

(30) Foreign Application Priority Data

Feb. 4, 2009 (EP) ..... 09152057

(51) Int. Cl.
*H04R 25/00* (2006.01)

(52) U.S. Cl.
USPC ..... 381/320; 381/328

(58) Field of Classification Search
USPC ..... 381/328, 312, 313, 320, 322, 324, 380; 181/129, 130, 135
See application file for complete search history.

(56) References Cited

U.S. PATENT DOCUMENTS

| | | | | |
|---|---|---|---|---|
| 5,195,139 | A * | 3/1993 | Gauthier | 381/322 |
| 5,369,625 | A * | 11/1994 | Gabrielson | 367/140 |
| 6,920,227 | B2 | 7/2005 | Chalupper et al. | |
| 7,263,837 | B2 * | 9/2007 | Smith | 62/6 |
| 2005/0013456 | A1 * | 1/2005 | Chalupper et al. | 381/312 |
| 2009/0268556 | A1 * | 10/2009 | Jiang et al. | 367/140 |

FOREIGN PATENT DOCUMENTS

| | | |
|---|---|---|
| EP | 1 154 673 A1 | 11/2001 |
| EP | 1 215 936 A2 | 6/2002 |
| EP | 1 499 159 A2 | 1/2005 |

OTHER PUBLICATIONS

Lin et al. Flexible, Stretchable, Transparent Carbon Nanotube Thin Film Loudspeakers. Oct. 29, 2008. Nano Letter, vol. 8, No. 12. pp. 4539-4545.*
Boullosa et al. Acoustic signal recovery by thermal demodulation. Applied Physics Letters, XP012086655, vol. 89, No. 17. Oct. 27, 2006, pp. 174106-1-174106-3.*
Xiao et al., "Flexible, Stretchable, Transparent Carbon Nanotube Thin Film Loudspeakers", Nano Letters, XP002534917, Oct. 29, 2008, col. 8, No. 12, pp. 4539-4545.
Boullosa et al., "Acoustic signal recovery by thermal demodulation", Applied Physics Letters, XP012086655, vol. 89, No. 17, Oct. 27, 2006, pp. 174106-1-174106-3.

* cited by examiner

*Primary Examiner* — Duc Nguyen
*Assistant Examiner* — Phan Le
(74) *Attorney, Agent, or Firm* — Birch, Stewart, Kolasch & Birch, LLP

(57) ABSTRACT

The invention relates to a hearing device 1 adapted for placement in, at or near a person's ear, the hearing device 1 comprising a microphone 2, a receiver 4 and a signal conditioning means 3 connected to the microphone 2 and to the receiver 4, the microphone 2 being arranged for receiving acoustical signals from the person's surroundings 7 and converting these acoustical signals into electrical signals and the receiver 4 being arranged for converting electrical signals into acoustical signals and transmitting these into the ear's ear canal 13. The object of the present invention is to provide a small, light-weight hearing device 1. The problem is solved in that the receiver 4 comprises a thermoacoustical transducer 18, which allows for a receiver 4 which may take up less space in the hearing device 1 and may have a smaller weight. This has the advantage of allowing the hearing device 1 to be small and light-weight, thus providing an improved wearing comfort. The invention may e.g. be used in hearing aids for compensating a person's loss of hearing capability.

19 Claims, 6 Drawing Sheets

HEARING DEVICE

TECHNICAL FIELD

The present invention relates to a hearing device. More specifically, the present invention relates to an electronic hearing device, such as e.g. a hearing aid, a listening device or an ear protection device, which receives acoustical signals from a person's surroundings, modifies the acoustical signals electronically and transmits the modified acoustical signals into the person's ear or ear canal.

The invention may e.g. be useful in applications such as a hearing aid for compensating a person's loss of hearing capability; a listening device for augmenting a person's hearing capability or an ear protection device for protecting a person's ear against damage from loud sounds.

BACKGROUND ART

The following account of the prior art relates to one of the areas of application of the present invention.

Electronic hearing devices, such as hearing aids, listening devices and ear protection devices, are well known in the art. Hearing aids and listening devices known in the prior art are typically small devices intended to be placed in, at or near the person's ear. Such devices may be categorized according to their placement, e.g. behind-the-ear (BTE), in-the-ear (ITE), in-the-ear-canal (ITC), completely-in-the-canal (CIC) or receiver-in-the-ear (RITE). In most cases, it is desirable that the hearing device be small and light-weight in order to improve the comfort of wearing. Ear protection devices may similarly be placed close to or within the ear canal, and should for the same reason be small and light-weight.

Known hearing devices typically comprise a main microphone, a receiver and a signal conditioning means connected to both the main microphone and the receiver. The main microphone receives acoustical input signals from the person's surroundings and converts these into electrical input signals, which it feeds to the signal conditioning means. The signal conditioning means modifies, e.g. amplifies, attenuates and/or filters, the electrical input signals and feeds the resulting electrical output signals to the receiver, which converts the electrical output signals into acoustical output signals and transmits these into the ear and/or the ear canal. In modern day hearing devices, the signal conditioning means typically comprises analog-to-digital and digital-to-analog converters and performs the signal conditioning digitally. Known receivers typically comprise an electromagnetic loudspeaker, the acoustically radiating body of which comprises a diaphragm driven by a permanent magnet, which moves relative to an electrically driven coil, or vice versa.

Hearing devices which are intended for partial or complete placement in the ear canal—or at the canal's opening into the outer ear, are typically designed to close the ear canal completely in order to create a defined acoustical chamber within the ear canal. However, an air-tight closing of the ear canal causes a discomfort known as occlusion. In order to avoid this, known hearing devices of this type are typically provided with a vent, which connects the ear canal with the ambient air. In the case that the hearing device comprises an ear plug for insertion into the ear canal, the vent is typically formed as a tubular channel extending through the ear plug.

The receiver radiates the acoustical signals into the ear and/or the ear canal, either directly or indirectly e.g. via a tube. Normally, it is desired to have well-defined signal amplification gains between the acoustical input signals received by the main microphone and the acoustical signals presented to the tympanum. However, the actual sound pressure levels at the tympanum depend not only on the sound pressure levels radiated by the receiver, but also on the acoustical impedances of the passage and/or tube leading from the receiver to the ear canal and of the acoustical chamber created within the ear canal. These impedances are often not known precisely and may further change with position and orientation of the hearing device relative to the ear and/or ear canal. Thus, the sound pressure level at the tympanum may vary. In order to allow for producing a more precise sound pressure level at the tympanum, the hearing device may be equipped with a monitoring microphone, which is arranged so that it receives acoustical signals from the chamber in the ear canal. The signal conditioning means may use the signals received by the monitoring microphone to modify the signals transmitted to the receiver in a manner suited to maintain a desired amplification gain. Such signal modifications may take place in various ways of which several are known in the art.

Depending on the configuration of the hearing device, mechanical vibrations induced by the diaphragm and/or other moving parts of the receiver may undesirably be fed back to the main microphone. The feedback may occur as acoustical feedback, e.g. through the vent, as mechanical feedback through the structure of the hearing device and/or as a combination of both, e.g. through the bone structure of the wearer and the ambient air. At large amplification gains, the feedback may cause the hearing device to howl or whistle, which may be very annoying for the wearer. In order to reduce the tendency to howl or whistle at large amplification gains, known hearing devices typically implement one or more methods for cancelling the feedback signal. A well known method comprises the steps of adaptively estimating the feedback signal on the basis of the signals presented to the receiver, subtracting the estimated feedback signal from the signal received by the main microphone, and using the resulting signal as input for the signal conditioning means. Alternatively, the signal conditioning means may e.g. reduce the amplification gain when it detects the presence of whistling or howling, and/or when it detects a situation in which the risk thereof has increased.

The signal conditioning means typically comprises an output stage for driving the receiver. In modern day hearing devices, the output stage typically comprises a so-called class D output amplifier, which switches its output between a positive and a negative voltage, thereby producing square-wave output signals. The switching typically takes place at a frequency at the upper end of or above the audible frequency range, and the switching signals are modulated to produce the desired output signals in the audible frequency range. The coil and magnet of the receiver typically serve as a low-pass filter to suppress undesired high frequency components of the square-wave output signals.

In their paper, "Flexible, Stretchable, Transparent Carbon Nanotube Thin Film Loudspeakers", published by The American Chemical Society on pp 4539-4545 of "Nano Letters 2008, 8 (12)", with the web publication date of Oct. 29, 2008, Lin Xiao et. al describe a loudspeaker formed from a carbon nanotube thin-film.

DISCLOSURE OF INVENTION

A problem of the prior art hearing devices is that the typical receivers are relatively large, which is especially undesired with devices intended to be worn by a person in or close to the ear. Furthermore, typical receivers are relatively heavy, which renders the hearing devices relatively susceptible to damage due to mechanical shocks, e.g. if they are dropped on a hard floor. The typical receivers also comprise delicate structures, some of which are moving and which are complicated and thus expensive to manufacture. The moving parts of typical receivers induce feedback, which may cause the hearing devices to howl or whistle, and the methods, which are typically implemented to reduce or prevent such howling or whistling, produce audible artefacts in the acoustical signals presented to the wearers of the devices and may even affect the wearer's ability to understand speech in some types of acoustical environments. Typical receivers require acoustical chambers behind the diaphragm in order for the receiver to achieve a reasonable efficiency. Such acoustical chambers increase the size of the hearing device and also introduce frequencies of resonance, which make the frequency characteristic of the receiver less linear. Typical receivers further comprise materials, which cannot be disposed of freely due to the risk of polluting the environment. Furthermore, the ear plug of prior art hearing devices must be regularly cleaned, and the chemicals used for cleaning may also pose a pollutive threat to the environment.

A further problem is that the diaphragm of the radiating body is typically rather small, so that the acoustical field in the ear canal varies substantially in the transversal direction of the ear canal. This causes the acoustical signals received by the monitoring microphone to depend highly on the position and orientation of the hearing device in the ear canal. Since these may change every time the hearing device is inserted into the ear, a reliable prediction of the sound pressure level at the tympanum is very difficult to obtain. The same uncertainty applies to the estimation of the acoustical feedback radiated through the vent.

A further problem is that the high switching frequency of the output amplifier limits the life time of the battery used for supplying energy to the hearing device, since each switch or swing of the output voltage requires a specific amount of energy.

An object of the present invention is to provide a small hearing device. This may contribute to an improved wearing comfort.

A further object of the present invention is to provide a hearing device with a light-weight receiver. This may make the hearing device less susceptible to damage due to mechanical shocks.

A further object of the present invention is to provide a hearing device with an improved sound quality. This may increase the usability of the hearing device and also contribute to an improved wearing comfort.

A further object of the present invention is to provide a hearing device with a receiver, which may be manufactured more easily and thus less expensive.

A further object of the present invention is to provide a hearing device with a receiver, which may be disposed of without risking a pollution of the environment. This may facilitate the development of hearing devices with disposable receivers, so that time-costly cleaning of the ear plug may be omitted and the possible pollutive effects of the cleaning on the environment may be reduced.

It is a further object of the present invention to provide a hearing device, which facilitates a reliable prediction of the sound pressure level at the tympanum. This may improve the comfort for the person using the hearing device.

It is also an object of the present invention to provide a hearing device, which is less susceptible to howling and whistling due to feedback. This may improve the comfort for the person using the hearing device and/or allow the use of larger amplification gains in the hearing device.

A further object of the present invention is to provide a hearing device, which enables a longer life time of the battery used for supplying energy to the hearing device. This may reduce the cost of using the hearing device and the pollutive effects on the environment.

Objects of the invention are achieved by the invention described in the accompanying claims and as described in the following.

An object of the invention is achieved by a hearing device adapted for placement in, at or near a person's ear, the hearing device comprising a main microphone, a receiver and a signal conditioning means being connected to both the main microphone and to the receiver, the main microphone being arranged for receiving acoustical input signals from the person's surroundings and being adapted for converting the acoustical input signals into electrical input signals and feeding the electrical input signals to the signal conditioning means, the signal conditioning means being adapted for modifying the electrical input signals into electrical output signals and feeding the electrical output signals to the receiver, and the receiver being adapted for converting the electrical output signals into acoustical output signals and being arranged for transmitting the acoustical output signals into the ear's ear canal, wherein the receiver comprises a thermoacoustical transducer. A thermoacoustical transducer may be manufactured from a material, which weighs substantially less than e.g. a coil and a magnet, so that the weight of the receiver may be reduced and the risk of damage due to mechanical shocks is reduced. A thermoacoustical transducer may further be shaped so that it utilises free space within the hearing device or on its surface, thus also enabling a reduction of the size of the hearing device. A thermoacoustical transducer may further be manufactured without moving parts, so that the manufacturing costs may be reduced. This may also make the receiver and/or the hearing device less sensitive to vibrations and mechanical shock, so that it may withstand e.g. being dropped on a floor without damage. Furthermore, the lack of moving parts may reduce the amount of vibrations induced mechanically into the hearing device and/or into the person's head. This may reduce the acoustical and/or the mechanical feedback to the main microphone and thus also reduce the hearing device's tendency to howl or whistle at large amplification gains. A thermoacoustical transducer may further allow for a smaller hearing device and/or a more linear frequency characteristic of the receiver, because it does not require the presence of any acoustical chambers behind the receiver.

Advantageously, the thermoacoustical transducer comprises carbon nanotubes. This material may provide a very effective thermoacoustical transducer and thus allows for an especially light-weight receiver structure. This material may further allow for a more linear frequency characteristic of the thermoacoustical transducer due to the frequency characteristic of the material itself.

Advantageously, the thermoacoustical transducer comprises carbon nanotube fibres. This material allows for an easy and inexpensive way of manufacturing a thermoacoustical transducer.

Advantageously, the thermoacoustical transducer comprises a carbon nanotube thin-film. This material allows for an even easier and even less expensive way of manufacturing a thermoacoustical transducer.

The hearing device may further comprise an ear plug adapted for placement in or close to the ear canal. Advantageously, the thermoacoustical transducer is embedded in a cavity in the ear plug and/or arranged on a surface of the ear plug. This allows for a large flexibility in the placement of the thermoacoustical transducer.

The ear plug may further have an inwardly directed surface arranged for facing the ear's tympanum. Advantageously, the thermoacoustical transducer is arranged on a portion of the inwardly directed surface. This allows for a direct transmission of acoustical signals from the thermoacoustical transducer to the tympanum.

Advantageously, the thermoacoustical transducer extends substantially across the inwardly directed surface. This allows for creating a substantially plane acoustical wave when transmitting acoustical signals into the ear canal, and may thus render the acoustical field in the ear canal less dependent on changing positions and/or orientations of the ear plug in the ear canal. The plane wave may further allow for a more predictable feedback and further allow a monitoring microphone placed in the ear canal to receive an acoustical signal with a more predictable relation to the acoustical signal at the tympanum.

The ear plug may be adapted for extending substantially across the ear canal, thereby separating an inner portion of the ear canal from the person's surroundings, and may further comprise a vent adapted for fluidly connecting the inner portion of the ear canal with the person's surroundings. Advantageously, the vent extends through the thermoacoustical transducer. This allows for a large flexibility in the relative arrangement of the vent and the thermoacoustical transducer.

Advantageously, the thermoacoustical transducer is permeable to gas. This allows the vent to extend through the thermoacoustical transducer.

Advantageously, the thermoacoustical transducer forms a disc-shaped body. This allows for creating a plane acoustical wave when transmitting acoustical signals into the ear or ear canal.

Advantageously, the thermoacoustical transducer forms a three-dimensional body. This allows for improving the efficiency and/or increasing the acoustical output of the thermoacoustical transducer.

Advantageously, the thermoacoustical transducer is arranged in a cavity in the ear plug. This allows for a simple way of protecting the thermoacoustical transducer against mechanical influences.

Advantageously, the cavity has a tubular shape. This allows for a very simple way of manufacturing the cavity and/or the thermoacoustical transducer.

Advantageously, the ear plug comprises a resilient member partly or entirely comprising the thermoacoustical transducer. This allows for a simple way of distributing the active material of the thermoacoustical transducer within a given volume.

Advantageously, the signal conditioning means comprises means for reducing the frequency of electrical signals being modified. This allows for driving the thermoacoustical transducer with electrical output signals of a lower frequency and hence a lower switching frequency, thus saving switching energy in the output stage of the signal conditioning means.

The hearing device may further comprise a monitoring microphone being connected to the signal conditioning means, the monitoring microphone further being arranged for receiving acoustical monitoring signals from the ear canal via an acoustical monitoring path, the monitoring microphone further being adapted for converting the acoustical monitoring signals into electrical monitoring signals and feeding the electrical monitoring signals to the signal conditioning means, and the signal conditioning means may further be adapted to modify the electrical output signals depending on the electrical monitoring signals. Advantageously, the acoustical monitoring path extends through the thermoacoustical transducer. This allows for a large flexibility in the arrangement of the thermoacoustical transducer relative to the acoustical monitoring path.

An object of the invention is achieved by a method of transmitting acoustical signals into a person's ear, the method comprising the steps of:

receiving acoustical signals from the person's surroundings, converting the acoustical signals into electrical input signals, modifying the electrical input signals into electrical output signals, converting the electrical output signals into acoustical output signals, and transmitting the acoustical output signals into the ear's ear canal, wherein converting the electrical output signals into acoustical output signals takes place by means of a thermoacoustical transducer arranged in or close to the person's ear canal. A thermoacoustical transducer may be manufactured from a material, which weighs substantially less than e.g. a coil and a magnet, so that the method may be performed in a device of less weight. A thermoacoustical transducer may further be shaped so that it utilises free space within a device or on its surface, so that the method may be performed in a smaller device. A thermoacoustical transducer may further be manufactured without moving parts, so that the method may be performed in a less expensive device. This may also make the device less sensitive to vibrations and mechanical shock. Furthermore, the lack of moving parts may reduce the amount of vibrations induced mechanically into the device and/or into the person's head.

Advantageously, the method further comprises the step of reducing the frequency of a portion of the electrical signals being modified. This allows for generating electrical output signals of a lower frequency and hence a lower switching frequency, thus saving switching energy in a device used for generating the electrical output signals.

Advantageously, the method further comprises the step of low-pass filtering a portion of the electrical output signals. This allows for reducing the amount of undesired high-frequency components of the transmitted acoustical output signals.

It is intended that the structural features of the system described above, in the detailed description of 'mode(s) for carrying out the invention' and in the claims can be combined with the method, when appropriately substituted by a corresponding process. Embodiments of the method have the same advantages as the corresponding systems.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element, or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1:
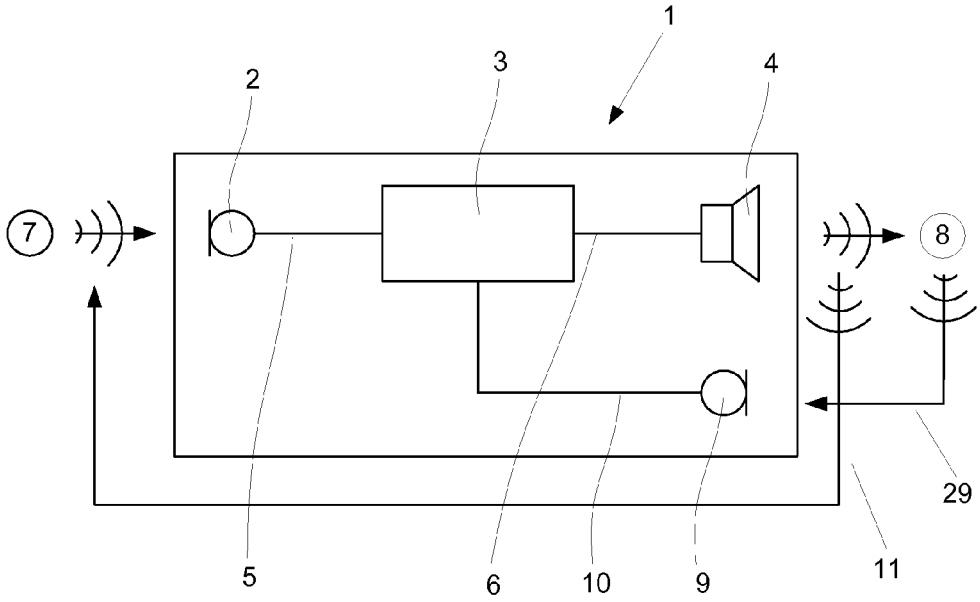
FIG. 1 shows a schematic of a hearing device as known in the prior art.

The hearing device 1 shown in FIG. 1 represents prior art hearing devices and comprises a main microphone 2, a signal conditioning means 3 and a receiver 4. The main microphone 2 is connected to the signal conditioning means 3 via a first electrical connection 5. The signal conditioning means 3 is connected to the receiver 4 via a second electrical connection 6. The main microphone 2 is arranged so that it may receive acoustical input signals from a person's surroundings 7. The receiver 4 is arranged so that it may transmit acoustical output signals into the person's ear 8. The hearing device 1 further comprises a monitoring microphone 9, which is connected to the signal conditioning means 3 via a third electrical connection 10. The monitoring microphone 9 is arranged so that it may receive acoustical monitoring signals from the ear canal of the person's ear 8 via an acoustical monitoring path 29. An acoustical feedback path 11 acoustically connects the receiver 4 with the main microphone 2 and comprises the various paths acoustical signals radiated by the receiver 4 may propagate to the main microphone 2.

The hearing aid 1 functions as follows. The main microphone 2 converts the received acoustical input signals into electrical input signals, which it feeds to the signal conditioning means 3 via the electrical connection 5. The signal conditioning means 3 modifies the electrical input signals and feeds the resulting electrical output signals to the receiver 4 via the electrical connection 6. The receiver 4 converts the electrical output signals into acoustical output signals. The signal modification taking place in the signal conditioning means 3 may comprise e.g. signal amplification, attenuation, compression, expanding and/or frequency shifting within predetermined frequency ranges depending on the purpose of the hearing device. The monitoring microphone 9 converts the acoustical monitoring signals into electrical monitoring signals and feeds them to the signal conditioning means 3, which modifies the electrical output signals further depending on the electrical monitoring signals in order to produce a desired sound pressure level at the tympanum 15 (see FIG. 2) of the person' ear 8.

Figure 2:
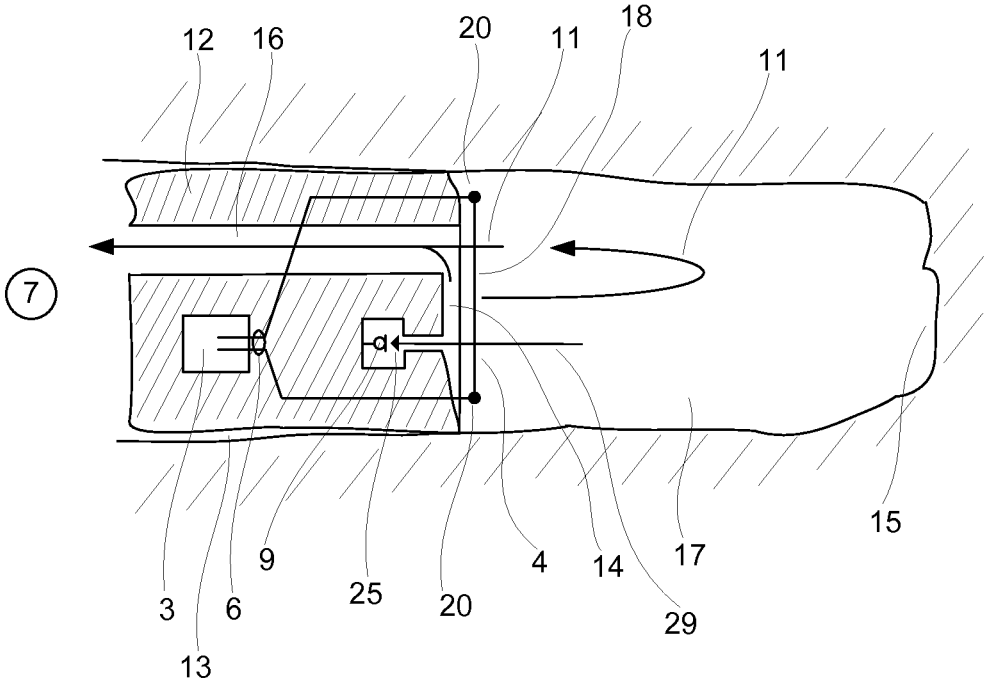
FIG. 2 shows a section through details of a first embodiment of a hearing device according to the present invention.

The ear plug 12 shown in FIG. 2 is comprised in a first embodiment of a hearing device 1 (see FIG. 1) according to the present invention. The ear plug 12 may constitute the entire hearing device 1 or it may comprise only parts hereof, e.g. the receiver 4 and a part of the signal conditioning means 3. In the latter case, the ear plug 12 may be connected to the remaining parts of the hearing aid 1 via e.g. an electrical or a wireless connection (not shown). The ear plug 12 is located in an ear canal 13 of a person, whereby it separates an inner portion 17 of the ear canal 13 from the person's surroundings 7. The ear plug 12 has an inwardly directed surface 14 facing the inner portion 17 of the ear canal 13 and thus also facing the tympanum 15 at the innermost end of the ear canal 13. The receiver 4 comprises a thermoacoustical transducer 18 comprising a disc-shaped body formed from a carbon nanotube thin-film similar to the ones described by Lin Xiao et al. The carbon nanotube thin-film comprises carbon nanotube fibres and is permeable to gas, such as air. The thermoacoustical transducer 18 extends substantially across the entire inwardly directed surface 14, and opposite ends of the carbon nanotube fibres are connected to a respective one of two electrodes 20. The signal conditioning means 3 comprises means for reducing the signal frequency of signals being modified (not shown). The signal conditioning means 3 further comprises an output stage (not shown), which is connected to the electrodes 20 via the electrical connection 6. A tubular vent 16 is formed through the ear plug 12, so that it fluidly connects the inner portion 17 of the ear canal 13 with the person's surroundings 7. Due to the gas permeability of the thermoacoustical transducer 18, the vent 16 also extends through the disc-shaped body of the thermoacoustical transducer 18 and hence through the receiver 4. A main microphone 2 (see FIG. 1) is located outside the ear plug 12, i.e. in the person's surroundings 7, preferably close to the ear or to the entry to the ear canal 13. An acoustical feedback path 11 extends from the thermoacoustical transducer 18 through the vent 16 to the main microphone 2. The acoustical feedback path 11 includes the inner portion 17 of the ear canal 13, because the thermoacoustical transducer 18 creates an acoustical field within the inner portion 17 of the ear canal 13, and because the acoustical field radiates acoustical signals through the vent 16. The ear plug 12 further comprises a monitoring microphone 9, which is located in a cavity 25, which opens into the inwardly directed surface 14 and which is thus fluidly connected to the inner portion 17 of the ear canal 13 through the disc-shaped body of the thermoacoustical transducer 18. Accordingly, a monitoring path 29 extends from the inner portion 17 of the ear canal 13 through the thermoacoustical transducer 18 to the monitoring microphone 9.

The hearing device 1 according to the first embodiment functions essentially as the prior art hearing device 1 shown in FIG. 1, however with the following novel functionality. The electrical output signals from the signal conditioning means 3 are applied to the carbon nanotube thin-film 18 via the electrical connection 6. Due to their inherent electrical resistance, the fibres of the carbon nanotube thin-film 18 get heated by the electrical signals applied to them. The carbon nanotube thin-film 18 is dimensioned so that the heat capacity of the carbon nanotube fibres 18 is so low that the temperature variation of the fibres is substantially proportional to the variation of the electrical current through the fibres during each half-cycle of the signals. The heat energy dissipated by the fibres is continuously transferred to the surrounding air, and a portion of it creates acoustical waves in the air. In this way, the fibres of the carbon nanotube thin-film 18 act as a thermoacoustical transducer 18, which converts the electrical output signals into acoustical output signals. A more detailed description of the working principle of thermoacoustical transducers may be found in the paper by Xiao Lin et al. and in the references cited therein. The thermoacoustical transducer 18 inherently radiates the acoustical output signals at twice the frequency of the applied electrical output signals. The signal conditioning means 3 therefore reduces the frequency of the signals being modified to half the original frequency in order to compensate for the frequency doubling in the thermoacoustical transducer 18. The output stage of the signal conditioning means 3 also switches its output levels at half the frequency of comparable output stages for prior art receivers. The fibrous structure of the carbon nanotube thin-film 18 allows acoustical waves to travel relatively unhindered through the disc-shaped body of the thermoacoustical transducer 18. This prevents occlusion, since any acoustical signals present in the inner portion 17 of the ear canal 13 may escape through the thermoacoustical transducer 18 and the vent 16. Furthermore, due to the planar configuration of the thermoacoustical transducer 18, the acoustical output signals travel as substantially plane waves from the thermoacoustical transducer 18 towards the tympanum 15. Therefore, the correlation between the acoustical monitoring signals received by the monitoring microphone 9 and the acoustical signals occurring at the tympanum 15 is less dependent on the position and orientation of the ear plug 12 in the ear canal 13 than in prior art hearing devices. The same applies for the correlation between the acoustical signals radiated by the receiver 4 and the acoustical feedback signals escaping through the vent 16 to the person's surroundings 7 and the main microphone 2.

Figure 3:
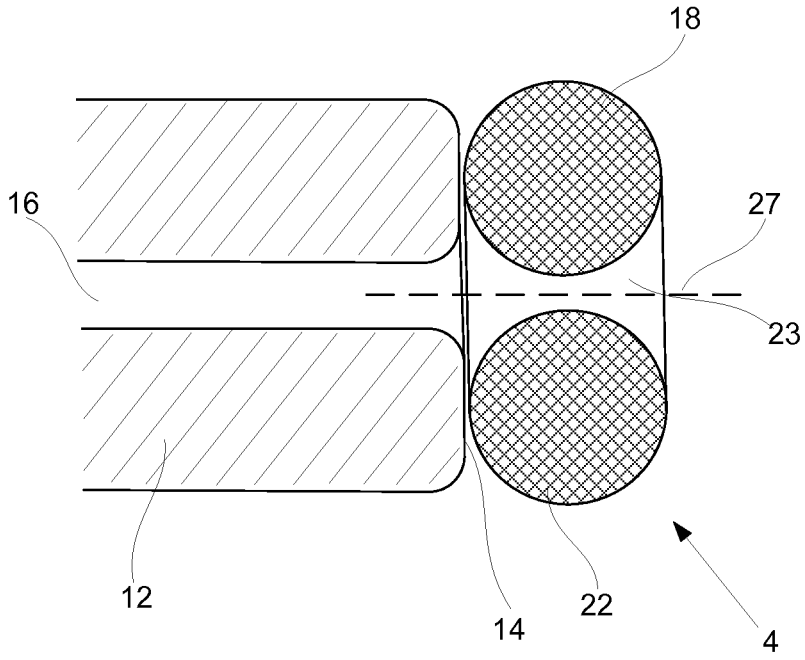
FIG. 3 shows a section through details of a second embodiment of a hearing device according to the present invention.

The ear plug 12 partly shown in FIG. 3 is comprised in a second embodiment of a hearing device 1 (see FIG. 1) according to the present invention. The thermoacoustical transducer 18 comprises a three-dimensional body substantially in the shape of a toroid with its axis of symmetry 27 arranged substantially perpendicular to the inwardly directed surface 14. The carbon nanotube fibres 18 are enclosed in a membrane 22 formed from a material suitable for allowing acoustical energy to pass through itself and at the same time protecting the fibres against e.g. ear wax, moisture and dust. Suitable materials may be selected from e.g. rubber, silicone or various polymer-based materials. An opening 23 through the centre of the toroid extends the vent 16 towards the inner portion 17 of the ear canal 13 (see FIG. 2). Shaping the thermoacoustical transducer 18 as a three-dimensional body allows for incorporating more carbon nanotube fibres in the transducer 18, thus allowing a higher acoustical signal output than from a plane transducer.

Figure 4:
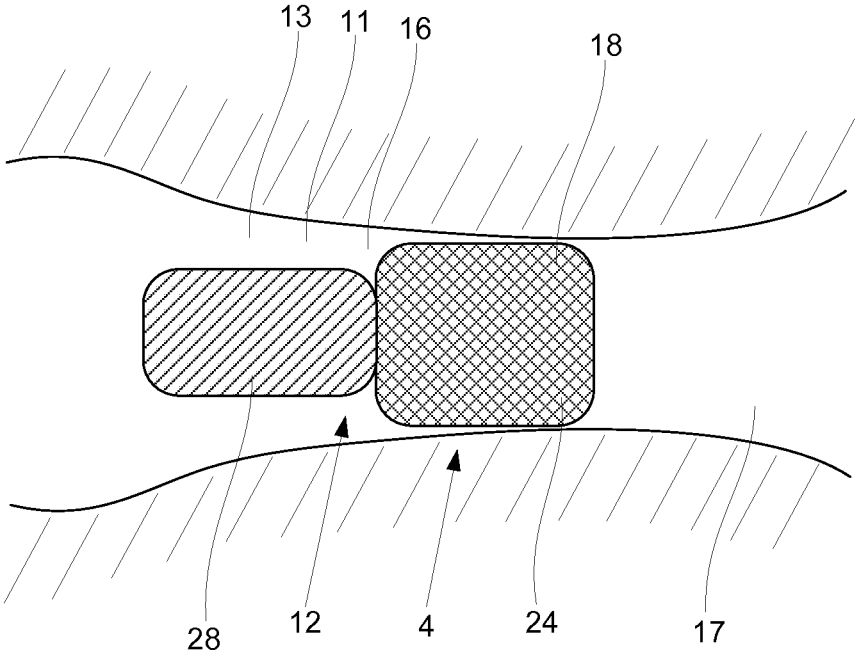
FIG. 4 shows a section through details of a third embodiment of a hearing device according to the present invention.

The ear plug 12 shown in FIG. 4 is comprised in a third embodiment of a hearing device 1 (see FIG. 1) according to the present invention. The carbon nanotube fibres of the thermoacoustical transducer 18 are incorporated in a resilient member 24, which has the shape of a circular cylinder and is dimensioned to close the ear canal 13 when inserted therein, whereby it separates an inner portion 17 of the ear canal 13 from the person's surroundings 7 (see FIG. 2). The resilient member 24 is formed from a foam material, which allows acoustical signals to travel relative unhindered through it. The fibres may be dispersed or distributed evenly in the resilient member 24 or e.g. concentrated in specific locations or volumes within the resilient member 24. This allows for a large flexibility in shaping the radiating body of the thermoacoustical transducer 18. The remaining parts of the ear plug 12 are located in a housing 28, which has a smaller diameter than that of the ear canal 13, thus allowing the vent 16 and consequently a portion of the acoustical feedback path 11 to extend along the outside of the housing 28. The resilient member 24 is permeable to gas and acoustical signals, so that the vent 16 also extends through it and thus through the thermoacoustical transducer 18.

Figure 5:
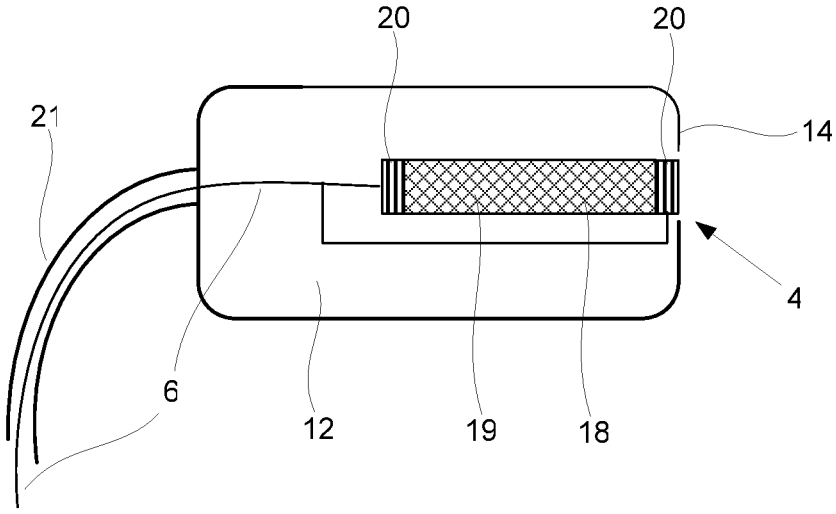
FIG. 5 shows a section through details of a fourth embodiment of a hearing device according to the present invention.

The ear plug 12 shown in FIG. 5 is comprised in a fourth embodiment of a hearing device 1 (see FIG. 1) according to the present invention. The thermoacoustical transducer 18 has the shape of a circular cylinder and is located in a tubular cavity 19 in the ear plug 12, and the tubular cavity 19 opens into the inwardly directed surface 14. Electrodes 20 are located at each axial end of the cylinder and connected to the carbon nanotube fibres of the thermoacoustical transducer 18 as well as to the output stage of the signal conditioning means 3 (see FIG. 1) via the electrical connection 6. The electrical connection 6 extends through a bendable tube or hose 21, which connects the ear plug 12 with the remaining parts of the hearing device 1. The thermoacoustical transducer 18 may e.g. be distributed evenly within the volume of the tubular cavity 19 or be arranged along its cylindrical surface.

Figure 6:
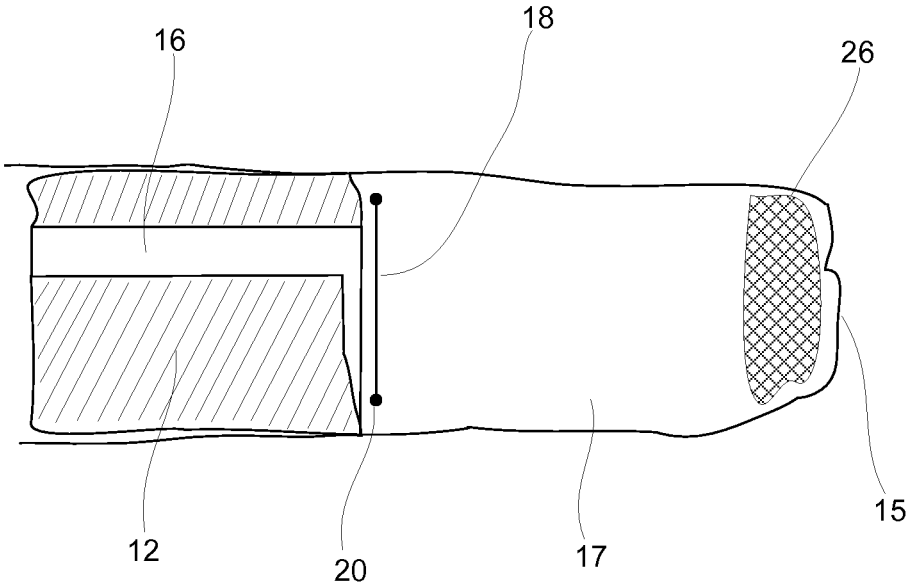
FIG. 6 shows a section through details of a fifth embodiment of a hearing device according to the present invention.

A fifth embodiment of a hearing device 1 (see FIG. 1) according to the present invention is partly shown in FIG. 6. The hearing device 1 comprises an ear plug 12 similar to the one shown in and explained in connection with FIG. 2 and is located in substantially the same location in the ear canal 13, whereby it separates an inner portion 17 of the ear canal 13 from the person's surroundings 7. The hearing aid 1 further comprises a frequency transforming member 26 comprising a material with a non-linear acoustical impedance and located close to the tympanum 15. The signal conditioning means 3 (see FIG. 1) further comprises means for shifting the frequency of the signals being modified to a frequency range well above the audible frequency range.

The hearing device 1 according to the fifth embodiment functions similar to the hearing device 1 according to the first embodiment, which was partly shown and explained in connection with FIG. 2. However, the signal conditioning means 3 shifts the frequency of the signals being modified to a frequency range well above the audible frequency range, e.g. by means of frequency or amplitude modulation of a high-frequency carrier signal, so that the signal frequencies of the electrical output signals fed to the receiver 4 and consequently also of the acoustical output signals radiated by the thermoacoustical transducer 18 are above the audible frequency range. The acoustical output signals hit the frequency transforming member 26, and due the non-linear acoustical impedance of the latter, an intermodulation of the signal frequencies occurs. The intermodulation produces acoustical signals in the audible frequency range. These signals are radiated from the frequency transforming member 26 towards the tympanum 15 and are thus audible to the person. The high-frequency carrier signal may have a frequency above 100 kHz or even as high as e.g. about 1 MHz.

The advantages of the hearing device 1 according to the fifth embodiment are several. Firstly, the efficiency of the thermoacoustical transducer 18 inherently increases with increasing signal frequency, so that the output stage of the signal conditioning means 3 may be dimensioned for smaller currents than if the signals were transmitted in the audible frequency range. Secondly, since the frequency range of the acoustical output signals radiated from the thermoacoustical transducer 18 is different from the frequency range of the acoustical input signals received by the main microphone 2, the tendency of the hearing device 1 to howl or whistle due to acoustical feedback from the thermoacoustical transducer 18 and/or from the ear plug 12 is substantially reduced. Thirdly, due to the higher signal frequency the acoustical output signals radiated from the thermoacoustical transducer 18 may be focused more directly towards the frequency transforming member 26 and the tympanum 15, thus increasing the efficiency of the receiver and also reducing the risk that the signals cause the hearing aid 1 to howl or whistle due to acoustical feedback through the bone structure surrounding the ear canal 13.

The novel features of the fifth embodiment of the present invention may alternatively be applied to other acoustical signal sources than a hearing device. A thermoacoustical transducer may e.g. be used for transmitting focused ultrasonic acoustical signals towards an arbitrary object comprising a material with a non-linear acoustical impedance. The object will then radiate audible acoustical signals as if it was an active sound source itself. This allows local sound radiation from objects without an own energy supply and may e.g. be used for attracting a customer's focus to specific offers in a super market.

Figure 7:
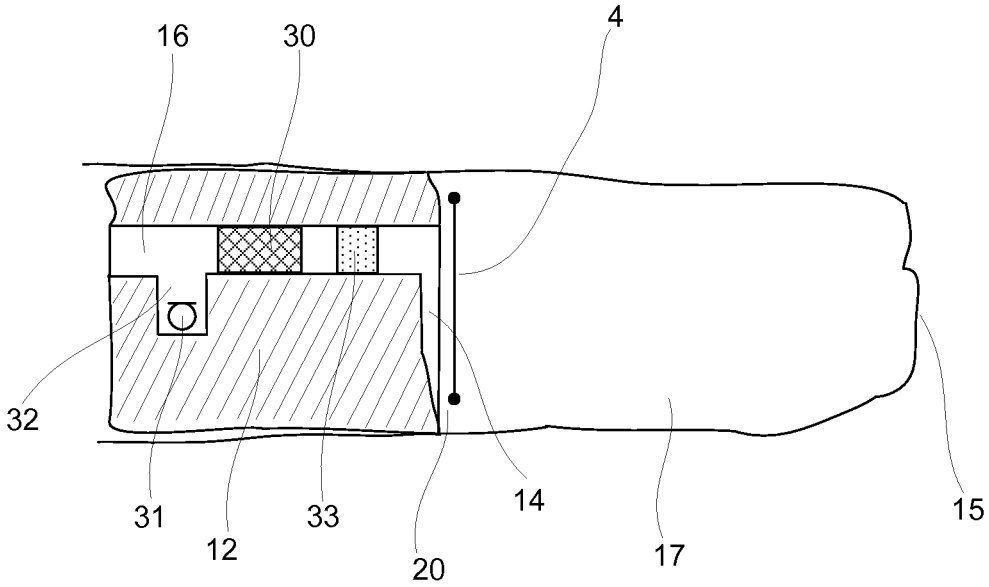
FIG. 7 shows a section through details of a sixth embodiment of a hearing device according to the present invention.

A sixth embodiment of a hearing device 1 (see FIG. 1) according to the present invention is partly shown in FIG. 7. The hearing device 1 comprises an ear plug 12 similar to the one shown in and explained in connection with FIG. 2 and is located in substantially the same location in the ear canal 13, whereby it separates an inner portion 17 of the ear canal 13 from the person's surroundings 7. The hearing aid 1 further comprises an auxiliary microphone 31 arranged in a cavity 32 opening into the vent 16. Alternatively, the auxiliary microphone 31 may be arranged close to or on a surface oriented towards the person's surroundings 7. The auxiliary microphone 31 is connected to an input of the signal conditioning means 3 and is adapted for converting acoustical signals received from the vent 16 into electrical reference signals and feeding these to the signal conditioning means 3. The hearing aid 1 further comprises an auxiliary transducer 30 arranged in the vent 16 and located between the opening of the cavity 32 and the inwardly directed surface 14. Alternatively, the auxiliary transducer 30 may be arranged close to or on a surface oriented towards the person's surroundings 7. The auxiliary transducer 30 is connected to an output of the signal conditioning means 3 and is adapted for converting electrical cancellation signals from the signal conditioning means 3 into acoustical cancellation signals and radiating these into the vent 16, or in an alternative embodiment, into the person's surroundings 7. The hearing aid 1 further comprises an acoustical dampening means 33 arranged in the vent 16 and located between the auxiliary transducer 30 and the inwardly directed surface 14. Alternatively, the acoustical dampening means 33 may be omitted. The acoustical dampening means 33 is adapted for dampening or attenuating acoustical signals travelling through the vent 16. The signal conditioning means 3 comprises means (not shown) for providing electrical cancellation signals in dependence of the electrical reference signals received from the auxiliary microphone 31 and feeding the electrical cancellation signals to the auxiliary transducer 30. Alternatively, the signal conditioning means 3 may comprise means for providing the electrical cancellation signals in dependence of the electrical input signals received from the main microphone 2.

The hearing device 1 according to the sixth embodiment functions similar to the hearing device 1 according to the first embodiment, which was partly shown and explained in connection with FIG. 2. However, the signal conditioning means 3 continuously and adaptively controls the electrical cancellation signals in such a way that the electrical reference signals received from the auxiliary microphone 31 are minimized. Several methods for this purpose are well known in the art. Thus, the acoustical feedback signals escaping towards the main microphone 2 through the vent 16 are substantially cancelled, and the risk of the hearing device 1 howling or whistling due to feedback is reduced or eliminated. The acoustical dampening means 33 reduces both the acoustical feedback signals and the influence of the acoustical cancellation signals on the acoustical field in the inner portion 17 of the ear canal 13.

An object of the invention is achieved by a hearing device 1 adapted for placement in, at or near a person's ear, the hearing device comprising a main microphone 2, a receiver 4, an auxiliary transducer 30 and a signal conditioning means 3 being connected to the main microphone 2, the receiver 4 and the auxiliary transducer 30, the main microphone 2 being arranged for receiving acoustical input signals from the person's surroundings 7 and being adapted for converting the acoustical input signals into electrical input signals and feeding the electrical input signals to the signal conditioning means 3, the signal conditioning means 3 being adapted for modifying the electrical input signals into electrical output signals and feeding the electrical output signals to the receiver 4, and the receiver 4 being adapted for converting the electrical output signals into acoustical output signals and being arranged for transmitting the acoustical output signals into the ear's ear canal 13, the signal conditioning means 3 further being adapted for providing auxiliary electrical signals and feeding the auxiliary electrical signals to the auxiliary transducer 30, and the auxiliary transducer 30 being adapted for converting the auxiliary electrical signals into auxiliary acoustical signals and being arranged for transmitting the auxiliary acoustical signals, wherein the auxiliary transducer comprises a thermoacoustical transducer. A thermoacoustical transducer may be manufactured from a material, which weighs substantially less than e.g. a coil and a magnet, so that the weight of the auxiliary transducer may be reduced and the risk of damage due to mechanical shocks is reduced. A thermoacoustical transducer may further be shaped so that it utilises free space within the hearing device or on its surface, thus also enabling a reduction of the size of the hearing device. A thermoacoustical transducer may further be manufactured without moving parts, so that the manufacturing costs may be reduced. This may also make the auxiliary transducer and/or the hearing device less sensitive to vibrations and mechanical shock, so that it may withstand e.g. being dropped on a floor without damage. Furthermore, the lack of moving parts may reduce the amount of vibrations induced mechanically into the hearing device and/or into the person's head. This may reduce the acoustical and/or the mechanical feedback to the main microphone and thus also reduce the hearing device's tendency to howl or whistle at large amplification gains. A thermoacoustical transducer may further allow for a smaller hearing device and/or a more linear frequency characteristic of the auxiliary transducer, because it does not require the presence of any acoustical chambers behind the auxiliary transducer.

All and any teachings of the present invention that are applicable to the receiver 4 of a hearing device 1, and all and any combinations hereof, may analogously be applied to an auxiliary transducer 30 of a hearing device 1.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims. For example, the features of the described embodiments may be combined arbitrarily.

The invention claimed is:

1. A hearing device adapted for placement in, at or near a person's ear, the hearing device comprising:

a main microphone;

a receiver;

a signal conditioner connected to the main microphone and to the receiver; and an ear plug adapted for placement in or close to the ear's ear canal, the ear plug being configured to extend substantially across the ear canal, thereby separating an inner portion of the ear canal from the person's surroundings, wherein the main microphone is arranged for receiving acoustical input signals from the person's surroundings and is adapted for converting the acoustical input signals into electrical input signals and feeding the electrical input signals to the signal conditioner, the signal conditioner is adapted for modifying the electrical input signals into electrical output signals and feeding the electrical output signals to the receiver, the receiver is adapted for converting the electrical output signals into acoustical output signals and is arranged for transmitting the acoustical output signals into the ear's ear canal, the receiver comprises a thermoacoustical transducer which is permeable to gas, the thermoacoustical transducer is embedded in a cavity in the ear plug and/or arranged on a surface of the ear plug, the ear plug further includes a vent arranged to fluidly connect the inner portion of the ear canal with the person's surroundings, and the vent extends through the thermoacoustical transducer.

2. A hearing device according to claim 1, wherein the thermoacoustical transducer comprises carbon nanotubes.

3. A hearing device according to claim 2, wherein the thermoacoustical transducer comprises carbon nanotube fibres.

4. A hearing device according to claim 2 or 3, wherein the thermoacoustical transducer comprises a carbon nanotube thin-film.

5. A hearing device according to claim 1, wherein the ear plug further includes an inwardly directed surface arranged for facing the ear's tympanum, and the thermoacoustical transducer is arranged on a portion of the inwardly directed surface.

6. A hearing device according to claim 5, wherein the thermoacoustical transducer extends substantially across the inwardly directed surface.

7. A hearing device adapted for placement in, at or near a person's ear, the hearing device comprising:

a main microphone;

a receiver including a thermoacoustical transducer having a toroid shape;

a signal conditioner connected to the main microphone and to the receiver; and an ear plug adapted for placement in or close to the ear's ear canal, the ear plug being configured to extend substantially across the ear canal, thereby separating an inner portion of the ear canal from the person's surroundings, wherein the main microphone is arranged for receiving acoustical input signals from the person's surroundings and is configured to convert the acoustical input signals into electrical input signals and to feed the electrical input signals to the signal conditioner, the signal conditioner is configured to modify the electrical input signals into electrical output signals and to feed the electrical output signals to the receiver, the receiver is configured to convert the electrical output signals into acoustical output signals and is arranged for transmitting the acoustical output signals into the ear's ear canal, the thermoacoustical transducer is embedded in a cavity in the ear plug and/or arranged on a surface of the ear plug, the ear plug further includes a vent arranged to fluidly connect the inner portion of the ear canal with the person's surroundings, and the vent extends through a center of the toroid shape of the thermoacoustical transducer.

8. A hearing device according to claim 1, wherein the thermoacoustical transducer forms a disc-shaped body.

9. A hearing device according to claim 1, wherein the thermoacoustical transducer forms a three-dimensional body.

10. A hearing device according to claim 1, wherein the thermoacoustical transducer is arranged in a cavity in the ear plug.

11. A hearing device according to claim 10, wherein the cavity has a tubular shape.

12. A hearing device according to claim 1, wherein the ear plug comprises a resilient member partly or entirely comprising the thermoacoustical transducer.

13. A hearing device according to claim 1, wherein the signal conditioner comprises a frequency reducer for reducing the frequency of a portion of the electrical signals being modified.

14. A hearing device according to claim 1, further comprising:

a feedback microphone being connected to the signal conditioner, the feedback microphone further being arranged for receiving acoustical feedback signals from the ear canal and/or the thermoacoustical transducer via a portion of an acoustical feedback path, the feedback microphone further being adapted for converting the acoustical feedback signals into electrical feedback signals and feeding the electrical feedback signals to the signal conditioner, and the signal conditioner further being adapted to modify the electrical output signals depending on the electrical feedback signals, wherein the portion of the acoustical feedback path extends through the thermoacoustical transducer.

15. A method of transmitting acoustical signals from a hearing device into a person's ear, the method comprising:

placing an ear plug of the hearing device in or close to the ear's ear canal, the ear plug being configured to extend substantially across the ear canal, thereby separating an inner portion of the ear canal from the person's surroundings, the ear plug further including a vent arranged to fluidly connect the inner portion of the ear canal with the person's surroundings;

receiving acoustical signals from the person's surroundings;

converting the acoustical signals into electrical input signals with a main microphone of the hearing device;

modifying the electrical input signals into electrical output signals with a signal conditioner connected to the main microphone and to a receiver;

converting the electrical output signals into acoustical output signals with the receiver which includes a gas permeable thermoacoustical transducer arranged in or close to the ear canal, the thermoacoustical transducer being embedded in a cavity in the ear plug and/or arranged on a surface of the ear plug; and transmitting the acoustical output signals into the ear's ear canal, wherein the vent extends through the gas permeable thermoacoustical transducer.

16. A method according to claim 15, the method further comprising the step of reducing the frequency of a portion of the electrical signals being modified.

17. A method according to claim 15, the method further comprising the step of low-pass filtering a portion of the electrical output signals.

18. A hearing device according to claim 7, wherein the thermoacoustical transducer is permeable to gas.

19. A method of transmitting acoustical signals from a hearing device that includes an ear plug into a person's ear, wherein the ear plug is placed in or close to the ear's ear canal, the ear plug being configured to extend substantially across the ear canal, thereby separating an inner portion of the ear canal from the person's surroundings, the ear plug further including a vent arranged to fluidly connect the inner portion of the ear canal with the person's surroundings, the method comprising:

receiving acoustical signals from the person's surroundings;

converting the acoustical signals into electrical input signals with a main microphone of the hearing device;

modifying the electrical input signals into electrical output signals with a signal conditioner connected to the main microphone and to a receiver;

converting the electrical output signals into acoustical output signals with the receiver which includes a thermoacoustical transducer having a toroid shape and arranged in or close to the ear's ear canal, the thermoacoustical transducer being embedded in a cavity in the ear plug and/or arranged on a surface of the ear plug; and transmitting the acoustical output signals into the ear canal, wherein the vent extends through a center of the toroid shape of the thermoacoustical transducer.

* * * * *